United States Patent [19]

Bassett et al.

[11] Patent Number: 4,928,959

[45] Date of Patent: May 29, 1990

[54] METHOD AND DEVICE FOR PROVIDING ACTIVE EXERCISE TREATMENT FOR A PATIENT SUFFERING FROM A BONE DISORDER

[75] Inventors: C. Andrew L. Bassett; Ian A. Cook, both of Bronxville, N.Y.

[73] Assignee: Osteo-Dyne, Inc., Charlotte, N.C.

[21] Appl. No.: 285,420

[22] Filed: Dec. 16, 1988

[51] Int. Cl.[5] ..... A63B 23/04

[52] U.S. Cl. ..... 272/96; 272/70; 272/76; 272/DIG. 6; 128/25 R; 128/25 B; 364/413.02; 364/413.27; 73/379; 340/573

[58] Field of Search ..... 272/76, 70, 129, 96, 272/DIG. 6, 146; 128/25 R, 24 R, 25 B, 33, 24.1; 364/413.02, 413.27; 73/379, 11; 340/573, 665, 540

[56] References Cited

U.S. PATENT DOCUMENTS

| | | | |
|---|---|---|---|
| 4,199,987 | 4/1980 | Bauers et al. | 73/379 |
| 4,216,956 | 8/1980 | Yamamura et al. | 272/70 |
| 4,274,282 | 6/1981 | Budraitis et al. | 340/665 X |
| 4,534,557 | 8/1985 | Bigelow et al. | 273/76 X |
| 4,735,195 | 4/1988 | Blum et al. | 272/70 X |
| 4,761,005 | 8/1988 | French et al. | 272/76 X |

FOREIGN PATENT DOCUMENTS

| | | | |
|---|---|---|---|
| 0143379 | 12/1978 | Japan | 173/379 |
| 0194359 | 11/1982 | Japan | 73/11 |
| 2094476 | 9/1982 | United Kingdom | 340/665 |

OTHER PUBLICATIONS

"Prevention of Osteophorosis by Pulsed Electro-Magnetic Fields: An in vivo Animal Model Identifying an Osteogenic Power Window", by Rubin et al, Department of Orthopaidics, State University of New York, at Stony Brook, Jul. 15, 1988.

Frollo et al, "Microprocessor-Board Instrument for Achilles Tendon Reflex Measurements", Med. and Biol. Eng. & Comput., Nov. 1981, No. 6, pp. 695-700.

Cochran et al., "Electromechanical Characteristics of Bone Under Physiologic Moisture Conditions" (Clinical Orthopaedics, 58: 249-270, 1968).

Bassett et al., "Augmentation of Bone Repair by Inductively Coupled Electromagnetic Fields" (Science, 1984: 575-77, 1974).

Bassett et al., "A Non-Operative Salvage of Surgically Resistant Pseudarthroses and Non-Unions by Pulsing Electromagnetic Fields, A Preliminary Report" (Clinical Orthopaedics, 124: 128-143, 1977).

Bassett et al., "Prevention of Disuse Osteoporosis in the Rat by means of Pulsing Electromagnetic Fields" (Brighton et al., Electrical Properties of Bone and Cartilatge, 311-313, 1979).

Cruess et al., "The Effect of Pulsing Electromagnetic Fields on Bone Metabolism in Experimental Disuse Osteoporisis" (Clinical Orthopaedics, 173: 235-250, 1983).

Bassett, "Effect of Force on Skeletal Tissues", Physiological Basis of Rehabilitation Medicine, Downey and Darling eds., 1st ed. W. B. Saunders Co., (1971), pp. 283-316.

Burrill et al., "Modification of Negative Calcium Balance and Bone Mineral Loss During Bed Rest: Impact Loading" (Abstract of USPHS Professional Association, 11th Annual Meeting, May 1976).

(List continued on next page.)

*Primary Examiner*—Richard J. Apley
*Assistant Examiner*—Joe H. Cheng
*Attorney, Agent, or Firm*—Finnegan, Henderson, Farabow, Garrett & Dunner

[57] ABSTRACT

A patient strikes a sensor in a manner to produce an impact load at an impact rate along the axis of a bone experiencing the bone disorder, and that impact load and impact rate are measured and compared to desired impact load and impact rate values to determine a success indicator of how close the patient came to the desired impact load and impact rate values in striking the sensor. The success indicator is provided to the patient as feedback for the active exercise treatment and is recorded.

21 Claims, 2 Drawing Sheets

OTHER PUBLICATIONS

Rubin et al., "Regulation of Bone Formation by Applied Dynamic Loads" ( The Journal of Bone and Joint Surgery, 66-A(3): 397-402, Mar. 1984).

Rubin et al., "regulation of Bone Mass by Mechanical Strain Magnitude" (Calcif. Tissue Int., 37: 411-417, 1985).

Lanyon et al., "Strain Related Electrical Potentials Recorded in vitro and in vivo" (Calcif. Tiss. Res., 22: 315-327 1977).

Lanyon, "Functional Strain in Bone Tissue as an Objective and Controlling Stimulus for Adaptive Bone Remodelling" (J. Biomechanics, 20: 11/12, 1083-1093, 1987).

Rubin et al., "Osteoregulatory Nature of Mechanical Stimuli: Function as a Determinant for Adaptive Remodelling in Bone" (Journal of Orthopaedic Research, 5: 300-310, 1987).

Rubin, "Sleletal Strain and the Functional Significance of Bone Architecture" (Calcif. Tissue Int., 36: S11-S18, 1984).

Mazess et al., "Single-and Dual-Photon Absorptiometry for Bone Measurement in Osteoporosis", Osteoporosis Update 1987, Genant, Ed. Radiology and Research Education Foundation, 1987.

METHOD AND DEVICE FOR PROVIDING ACTIVE EXERCISE TREATMENT FOR A PATIENT SUFFERING FROM A BONE DISORDER

BACKGROUND OF THE INVENTION

1. Field of the Invention

The present invention relates generally to a method and device for providing a programmed active exercise treatment for increasing the amount, strength and proper anatomical distribution of skeletal tissue in a patient suffering from a bone disorder.

2. Description of the Prior Art

The present invention relates to a number of disorders of skeletal tissue in which an active exercise treatment may be employed. These disorders include situations involving both acute and chronic fractures of bones, replacement of joints with artificial prostheses, leg-lengthening procedures, and generalized or diffuse osteoporosis.

When a bone is broken, acute fracture healing is triggered by a so-called "injury potential" which can be measured across two sides of the fracture. As early healing progresses, governed in part by bioelectrical mechanisms, the ends of the bone become joined by a tissue known as "bridging callus," which serves to anchor the ends of the fractured bone to one another. With time, this tissue is remodeled from a weak, woven (fetal), unstructured bone, to strong, well-organized, highly structured bone tissue. This maturation phase of the fracture repair process may be enhanced by applying compressive loads to the bone, directed along its axis, and of appropriate amplitude and rate of loading. This phase is also mediated by bioelectric processes, as mechanical energy is transduced by the piezoelectric and electrokinetic properties of bone to a modification of the activity of the bone cells in selected ways and at selected sites (discussed below under Scientific Studies). This stress working process serves to hasten maturation of the newly formed, unstructured, repair-bone, and consequently reduces the amount of time a limb needs to be externally immobilized (e.g., to be in a cast or a frame). Furthermore, cast immobilization and fracture repair are often accompanied by a depletion of bone mass (localized disuse osteoporosis) in structures at a considerable distance from the fracture itself. In weight bearing bones, rehabilitation often is retarded by stress pain in response to the bone loss which accompanies casting. Internal fixation with nails or plates, also, results in disuse osteoporosis as the result of stress-relief, the repair process itself, and motor disability.

It is well recognized by orthopaedic surgeons and other physicians that early functional use of a broken extremity is desirable to speed a patient's rehabilitation. Few doctors or patients, however, have recognized that the benefits of function (e.g. weight-bearing) derive, mainly, from brief intervals of controlled axial compression loading at critically rapid rates (i.e., impacting). In fact, most patients, after fracture, are unable to load with appropriate impact unless taught specific methods with effective monitoring methods to achieve this end. Furthermore, loading patterns which do not produce axial impact compression may introduce mechanically-deleterious torque, shear, or bending moments at rates too slow to improve the function of bone cells.

Thus it is desirable to provide a means for individuals with fractures to achieve appropriate compressive loading of their fractured bones to accelerate the maturation (strengthening) process. The loading patterns of these compressive forces should be controlled so that the stimulus for remodeling is below that which would produce acute or fatigue failure of the structurally evolving new bone.

About 5% of long bone fractures fail to heal in the normal tissue and fashion. In these cases the long bone fractures fail to unite and proceed to "delayed union" or "non-union." These conditions are characterized by a persistence of soft tissue opposite and within the fracture gap. In order to institute the final phases of repair, usually months to years after the original injury was sustained, it is necessary to initiate calcification and vascularization of these soft tissues. A commonly used method to achieve these ends is the use of selected pulsed electromagnetic fields delivered through a coil(s) attached to the cast over the old fracture site. Once the repair process is re-instituted, both the surgeon and the patient are desirous of reducing the total time required in cast before unrestricted function can begin. Rapid maturation of the bridging, unstructured new bone, without overloading, is a sine qua non for early rehabilitation. The principles of controlled, active, axial compression exercise to achieve these ends have been enunciated and clinically used successfully for the past ten years, but without an effective device to guide the patient in the loading program.

Osteoporosis is a chronic disorder which usually, but not exclusively, afflicts older women. Others who may be affected by this disorder include those who are confined to bed and even astronauts who are in a weightless environment. Osteoporosis is characterized by a decrease in the density of mineralized bone mass which makes the affected bones more fragile and therefore more susceptible to breakage.

Osteoporosis is frequently a debilitating problem. The injuries which result from osteoporosis often require extended hospitalization, and sometimes involve costly and painful surgery (e.g. total hip joint replacement). Health care costs for this condition approach ten billion dollars per annum in the United States alone. In addition, osteoporosis severely diminishes the vitality and mobility of those who suffer from this disease.

The general population also feels the effects of this disorder. Individuals who are afflicted with osteoporosis must depend upon relatives and others for care, and the health care and hospital costs are borne by everyone.

Osteoporosis occurs when the destruction of bone occurs at a rate faster than that with which new bone formed. The balance between destruction and formation is governed by hormones, calcium intake, vitamin D and related compounds, weight, smoking, alcohol consumption, exercise and other factors.

Much effort in the medical community has been focused on slowing or reversing bone loss through administering estrogens, calcitonin, calcium, fluorides, and thiazides, and recommending exercise. None of these modalities has been entirely successful in restoring bone mass to a severely depleted skeletal system.

Thus, it is desirable to find new methods for treating osteoporosis. A promising avenue is based upon a physiologic principle known as Wolff's law, which states that bone adapts its internal structure in response to the forces which act upon it. In other words, bone will remodel itself so that it is optimally structured to bear the applied stress.

Research has shown that Wolff's law is enacted, in part, through bioelectric processes. Because bone is piezoelectric and electrokinetic, it generates an electrical signal in response to mechanical forces. This internally-generated electrical signal then has a positive effect on bone formation. The principles of axial impact exercise just noted for fracture care apply equally well for osteoporosis. Not only can they prevent bone loss but they can restore bone mass and strength, once lost. The key to their success in this pathologic entity, again, rests on achieving a critically rapid skeletal loading rate to activate bone forming cells. For individuals with low bone mass, the amount of loading must be consonant with the amount of residual bone and it is increased as the mass increases in response to appropriately controlled active exercise.

Joint replacement surgery now involves two major types of bonding between the endoprosthesis(es) and bone. One makes use of a filler material (glue), such as methyl methacrylate. The second, newer method relies on the ability of bone to grow into a porous surface of the implant (metal, plastic, or composite), thereby locking the device in place. Biologically, the postsurgical response is similar to fracture healing, with an initial deposition of woven (fetal), unstructured bone at the interface between host bone and the implant and within its porous interstices. The rate of rehabilitation following joint replacement in the lower extremities is determined by the rate at which interfacial new bone can be stress-worked (remodeled) without a shearing failure. Excessive, early loading can convert new bone into fibrous tissue, producing a post-surgical failure. It is important, if not imperative, therefore, to control the amount of applied load and to keep its rate of increase consistent with the ability of interfacial bone to mature without a materials or cellular failure.

In order to equalize significant leg length inequality in adults, a mid-shaft (diaphyseal osteotomy often is performed after the application of a distractable external fixator. When the early repair of this iatrogenic fracture is in progress, at about 3–4 weeks post-operatively, daily controlled distraction is begun and continued until limb length equality is achieved or approached. Post-lengthening, the return of sufficient strength to the operated limb to permit unrestricted function is determined by loading patterns. Again, controlled, active, axial compressive impact exercise can be a useful adjunct to increase the rate of maturation without a material failure in the repairing segment.

The interactions between bone structure and mechanical forces has been studied scientifically. One of the first and most complete investigations into the effects of mechanical loading on bone tissues was reported by Cochran et al. in "Electromechanical Characteristics of Bone Under Physiologic Moisture Conditions," (Clinical Orthopaedics, 58:249–70, 1968). In that publication, it was shown that electrical potentials were developed in bone in response to mechanical stresses, both with in vivo and in vitro studies. This work contributed to the successful use of electromagnetic stimulation to modify bone tissue, as reported by Bassett et al. in "Augmentation of Bone Repair by Inductively Coupled Electromagnetic Fields," (Science, 184:575–77, May 1974) and Bassett et al. "A Non-Operative Salvage of Surgically Resistant Pseudarthroses and Non-Unions by Pulsing Electromaqnetic Fields, A Preliminary Report," (Clinical Orthopaedics, 124:128–43, 1977). The importance of bioelectric phenomena in osteoporosis has been reported in part by Bassett et al. in "Prevention of Disuse Osteoporosis in the Rat by Means of Pulsing Electromagnetic Fields" (Brighton, et al., Electrical Properties of Bone and Cartilage: Experimental Effects and Clinical Applications, 1979), and by Cruess et al. in "The Effect of Pulsing Electromagnetic Fields on Bone Metabolism in an Experimental Model of Disuse Osteoporosis" (Clinical Orthopaedics, 173:245, 1983).

In the paper by Cochran, et al. (above), it was demonstrated that the mechanical loading of bone needed to occur at a particular rate in order to generate maximal voltages. To this end, patients have been treated with axial compression exercise, at prescribed rates of loading, as reported by C.A.L. Bassett, "Effect of force on skeletal tissues", (*Physiological Basis of Rehabilitation Medicine,* Downey and Darling eds., 1st ed., W.B. Saunders Co., 1971, pp. 312–314). In these exercises, patients used a fish scale to approximate the maximum impact of their compression exercise, but they had no way to quantify the rate at which the impact took place.

Other research into mechanical methods to control bone loss have been reported For example, the National Aeronautics and Space Administration funded a project to study the use of impact loading on individuals' heels to stimulate bone formation. Reference to this work was made in an abstract printed in the USPHS Professional Association, 11th Annual Meeting (May 1976) proceedings, and entitled "Modification of Negative Calcium Balance and Bone Mineral Loss During Bed Rest." The abstract reported that impact loading, which was limited to a maximum of 25 pounds, could slow down the loss of calcium.

Rubin and Lanyon have also investigated the relationship between mechanical forces and bone formation, and have suggested that periodic strain rates and cyclic patterns generate a maximal osteogenic response in avian bones. In "Regulation of Bone Formation by Applied Dynamic Loads", (Journal of Bone and Joint Surgery, 66-A(3): pp. 397–402, March 1984), cyclic loading at 0.5 Hz caused bone formation to be augmented. In "Regulation of Bone Mass by Mechanical Strain Magnitude," (Calcified Tissue International, 37:411–417, 1985), it was shown that a dose relationship exists between peak strain applied and change in bone tissue mass.

The challenge of utilizing these facts is to translate this general laboratory information into clinically effective devices and methods for treating the bone disorders discussed above.

It is therefore an object of the present invention to devise a treatment method and device for selected bone repair situations which are both safe and effective.

It is a further object of the present invention to employ the concept of a critical loading factor in the treatment method and device.

Additional objects and advantages of the present invention will be set forth in the description which follows, and in part will be apparent from the description, or may be learned by practice of the invention. The objects and advantages of the invention may be realized and obtained by means of the instrumentalities and combinations particularly pointed out in the appended claims.

SUMMARY OF THE INVENTION

To achieve the aforementioned objects, and in accordance with the purposes of the invention as embodied and broadly described herein, there is provided a method of providing active exercise treatment for increasing the amount, strength, and proper anatomical distribution of skeletal tissue in a patient suffering from a bone disorder. This method comprises the step of determining, from selected characteristics of the patient's skeletal tissue, desired values for impact load and rate in order to provide treatment for the bone disorder, the desired impact load and rate values being chosen to generate electrical signals in the patient's skeletal tissue such that the predominant energy distribution will be between 0.1 Hz and 100 kHz, with notable energy distribution in the range of 6 to 16 Hz. The method further comprises the steps of repeatedly striking a sensor by the patient in a manner to produce an impact load along the axis of a bone experiencing the bone disorder, automatically measuring the impact load generated from the patient's striking of the sensor, automatically measuring the rate of the striking of the sensor, automatically comparing the measured impact load with the desired impact load value and automatically comparing the desired impact rate value to the measured impact rate value to determine a success indicator of how close the patient came to the desired impact load values in striking the sensor, providing the success indication to the patient automatically as feedback for the active exercise treatment, and, recording the success indicator determined during the exercise treatment.

Also in accordance with the present invention, a device provides active exercise treatment for increasing the amount, strength and proper anatomical distribution of skeletal tissue in a patient suffering from a bone disorder by causing a desired impact load at a desired impact rate to be imparted to the patient such that the desired values for impact load and impact rate cause the patient's skeletal tissue to generate an electrical signal having the majority of its energy between 1 Hz and 100 kHz, with notable energy distribution in the range of 6 to 16 Hz. The device comprises sensing means adapted to be repeatedly struck by the patient in a manner to produce an impact load to the patient along the axis of a bone experiencing the bone disorder, impact load measuring means, coupled to the sensing means, for measuring the impact load generated from the striking of the sensing means, and impact rate measuring means, coupled to the sensing means, for measuring the rate of striking of the sensing means by the patient. The device further comprises processing means, coupled to the impact load measuring means and to the impact rate measuring means, for comparing the measured impact load with the desired impact load value and for comparing the measured impact rate with the desired impact rate value to determine a success indicator of how close the patient came to the desired impact load value in striking the sensing means, feedback means, coupled to the processing means for providing the success indicator to the patient as feedback for the active exercise treatment and recording means, coupled to the processing means, for recording the success indicator determined during the exercise treatment.

The sensing means may include a strain-gauge device or a piezoelectric sensor. Alternatively, the sensing means may include an acoustic means, an accelerometer, an interferometer or a sensor producing an analog output. The measuring means includes as analog-to-digital converter for converting the output of the sensing means to a digital signal. The processing means may include a microprocessor or discrete digital microelectronic logic device.

The feedback means may include a light-emitting device, a tone-producing circuit including a buzzer, a visually-detectable meter, or a device for emitting synthesized speech sounds. The recording means may include a printer for recording the success indicator value or a microelectronic memory device.

BRIEF DESCRIPTION OF THE DRAWINGS

The accompanying drawings, which are incorporated in and constitute a part of the specification, illustrate a presently preferred embodiment of the invention and, together with the general description given above and the detailed description given below, serve to explain the principles of the invention.

DESCRIPTION OF THE PREFERRED EMBODIMENT

Reference will now be made in detail to the presently preferred embodiment of the invention as illustrated in the accompanying illustrations.

Figure 1:
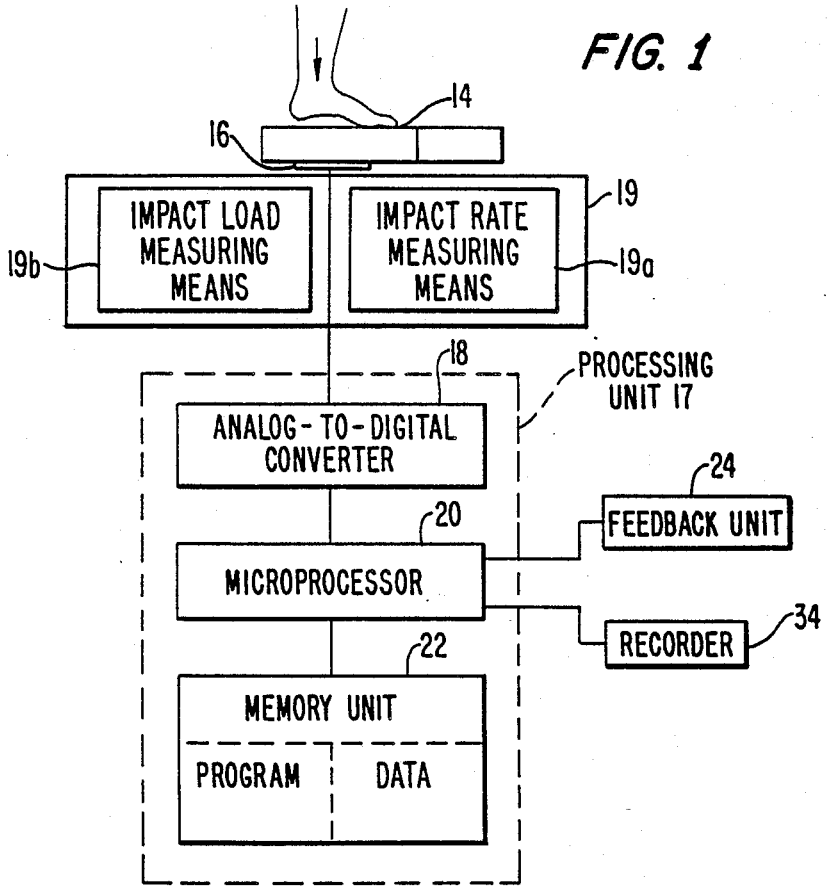
FIG. 1 is a block diagram of the constituent subsystems of a device for providing active exercise treatment for a patient suffering from bone disorders incorporating the teachings of the present invention.
Figure 2:
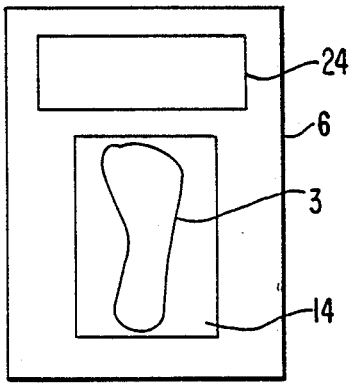
FIG. 2 is an elevational view of the base of the device described in FIG. 1.
Figure 3:
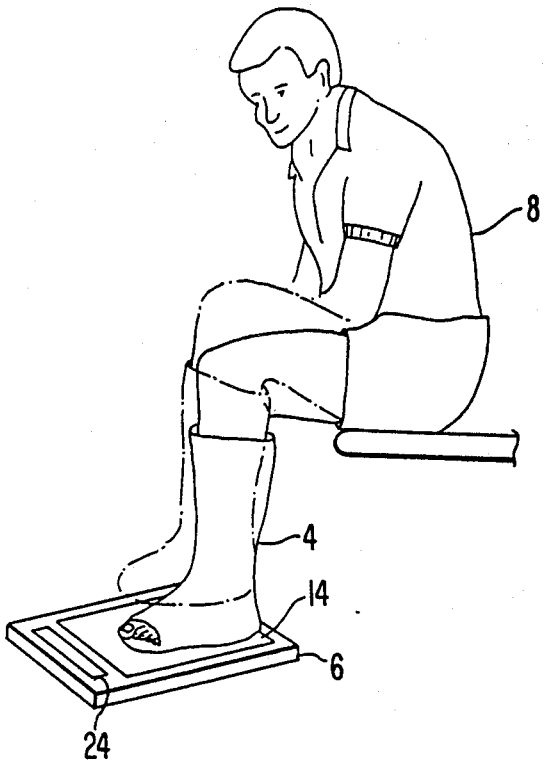
FIG. 3 is a perspective, side view of the device of FIG. 2.

In accordance with the present invention, there is provided a method of providing active exercise treatment to increase the amount, strength, and proper anatomical distribution of skeletal tissue in a patient suffering from a bone disorder. This method can employ a variety of structures and apparatuses. One example of the structures and apparatuses is shown in FIGS. 1 through 3.

The first step in the method is to determine a desired value for impact load and rate in order to provide treatment for the bone disorder. This determination is based upon the patient's clinical situation (e.g., obliquely fractured tibia) and certain characteristics of the patient's skeletal tissue. The patient's skeletal tissue characteristics can include the amount of bone, as well as the bone's strength and anatomical distribution. The desired impact load and rate values are chosen to generate electrical signals in the patient's skeletal tissue which promote appropriate bone formation maturation and spatial distribution while minimizing possible adverse effects, such as micro- or gross fracture or stress pain from an excessive cyclic load, rate, or treatment duration. Additional factors, including age, gender, general health, other disorders (e.g. diffuse osteoporosis, parathyroid abnormalities), medication use (e.g. steroids), height and weight, may play a role in determining the optimal loading parameters for a qiven patient.

The physician may also raise the values for impact load and rate as the patient ameliorates the structure of his bone(s) in a progressive exercise regimen. The status of skeletal elements may be assessed through such methods as dual photon absorptiometry and other radiologic techniques.

The objective of the exercises is to stimulate the bone's innate ability to respond to externally-applied forces. Experimental work (including that by Lanyon and Hartman, ("Strain related electrical potentials recorded in vitro and in vivo," Calcified Tissue Research 22:315–327, 1977)) has indicated that useful exercises will create electrical responses with energy distributed between 0.1 Hz and 100 kHz, with the band of 6 to 16 Hz playing a particularly important role. It has been found that electrical responses are directly related to the impact load in this frequency range. Consequently, the subsystem of the device which determines success or failure of an exercise attempt will compare the actual characteristics generated during the exercise attempt with the ideal characteristics of an exercise which would yield energy distributed in the frequency range above.

The method further comprises the step of repeatedly striking a sensor by the patient in a manner to produce an impact load along the axis of a bone experiencing the bone disorder, measuring the impact load generated from the patient's striking of the sensor, and measuring the rate of impact from the patient's striking. The measured impact load and rate are then automatically compared with the desired impact load value and impact rate values, respectively, to determine a success indicator value of how close the patient came to the desired load value and desired rate value in striking the sensor. The success indicator value is provided to the patient as feedback for the active exercise treatment, and is also recorded. The patient repeats the striking until the desired number of successful exercise impacts has been accomplished. Treatment duration is based upon the clinical judgment of the physician. The desired impact rate and the desired treatment duration, like the desired impact load, are based upon the characteristics of the patient's skeletal tissue.

A device according to the present invention for use in providing active exercise treatment in a patient suffering from a bone disorder will now be described in detail with reference to FIGS. 1 through 3.

In accordance with the present invention, the device includes sensing means adapted to be struck by the patient in a manner to produce an impact load to the patient along the axis of the bone experiencing the bone disorder. In FIG. 1, the sensing means can include a plate 14. Plate 14 may advantageously be fabricated from a plastic polymer (e.g., acrylic). Patient 8 as shown in FIG. 3 repeatedly strikes plate 14 in a manner to produce an impact load along the axis of a bone experiencing the bone disorder.

In accordance with the present invention there is further provided measuring means, attached to the sensing means for measuring the impact load generated from the striking of the sensing means. Measuring means 19 may include impact rate measuring means 19*a* and impact load measuring means 19*b*. Measuring means 19 is attached to a sensor shown as 16 in FIG. 1. Sensor 16 may be fabricated from a piezoelectric film (e.g., Kynar) which has been bonded to plate 14 or may be another kind of sensor appropriate to the purpose of this invention such as an acoustic transducer, an accelerometer or an interferometer. Sensor 16 generates a signal to measure the impact load generated from the striking of plate 14. The signal may be an analog output in which case an analog-to-digital converter 18 may be included for converting the analog output to a digital signal. Using contemporary microelectric techniques, the converter may consist of a single integrated circuit chip or may comprise several discrete electronic components.

A processing means is provided for comparing the measured impact load with the desired impact load to determine a success indicator of how close the patient came to the desired impact load value in striking the sensing means. Processing unit 17 may include a microprocessor 20. The digital representation of the signal from converter 18 is fed to microprocessor 20 which is in communication with a memory unit 22. Memory unit 22 may contain both a program of instructions for microprocessor 20 and the criteria for determining a success indicator of how close the patient came to the desired impact load in striking the sensor. Microprocessor 20 may advantageously employ a microelectronic single-chip processing circuit, and memory unit 22 may advantageously employ a mixture of elements including a preset chip-based (Read Only Memory or ROM chip) program combined with alterable encodings of the exercise judging criteria, e.g., removable and reprogrammable memory such as RAM, EEPROM, or magnetic-based memory elements such as disks or bubble memory. The alterable encodings may also include a card into which a program is built. The cards may be individualized according to the needs of each individual patient and according to each stage of healing. The processing means may also create a log of use in memory unit 22. This record of usage pattern may be used by a physician caring for the patient in determining alterations in the exercise regimen so as to improve the patient's skeletal condition.

Feedback means are provided for providing the success indicator to the patient as feedback for the active exercise treatment. The feedback means preferably includes a feedback unit 24 which make the results of the treatment known to the patient once processing unit 17 has determined the outcome of a particular exercise attempt. To accomplish this, feedback unit 24 may include a tone producing circuit for emitting an audible tone of such pitch and timbre as to denote success or failure such as a buzzer, a lamp or a light-emitting diode of a color chosen to denote success or failure, a visually-detectable meter, or a device for producing synthesized speech sounds to convey this information.

In accordance with the present invention there is provided recording means for recording the success indicator determined during the exercise treatment. The recording means may include a recorder 34, such as a printer for recording the success indicator or even a memory unit such as memory unit 22.

The device according to the present invention further comprises means for adjusting the criteria used for the success indicator. This adjustment may be by means of at least one control resistor or switch which may be reset in accordance with the progressive regimen described above. The adjustment means may also include a microelectronic memory device which may be revised under the direction of the physician caring for the user, or may include a removable circuit board which indicates to microprocessor 20 which one of a number of possible criteria for success from memory unit 22 should be employed for the patient at any given time. The device may also include means, such as a lamp or a buzzer, for generating a signal of the time for a succeeding treatment.

To provide exercise to a bone with a repairing discontinuity, the individual uses the device of the present invention and performs an exercise to compress the broken bone by repeatedly striking a designated surface of the device. As shown in FIG. 3, patient 8 performs exercises to enhance the rehabilitation of the fractured bone, e.g. in this illustration, a fracture of the tibia of the lower leg. Although shown in treating legs, the present invention is broadly applicable for all limbs, including arms. In the treatment, a plaster or plastic cast 4 is conventionally placed around the leg. The patient performs exercises by striking the heel of casted limb 4 against surface plate 14 which is mounted horizontally in base 6. In this situation, plate 14 may be marked with symbols (FIG. 2) to help the user to align his limb 4 for proper performance of the exercises, such as the outline of a foot 3, arrows, lines, circles and curves, and text elements. Any visual display of information from feedback unit 24 may be accomplished by placing indicators, lamps, and the like in a position so as to be visible to someone seated or standing and striking his casted limb against the device.

To provide exercise to a patient with a generalized bone disorder such as diffuse osteoporosis, the individual uses the device of the present invention and performs an exercise by standing atop the device and striking a designated surface of the device with his or her heels. This impact of heels against the device creates a force which is transmitted through the skeleton and can therefore treat the diffuse osteoporosis condition. This exercise may advantageously be conducted by rising up on the forefoot, thus elevating the heels above the device, and then suddenly relaxing the supporting musculature of the leg to allow the heels to drop and strike the device.

As explained above, the nature of that "impact event" from the exercise attempt is measured by sensor attached to or embedded in the impacted surface of the device. The nature of the impact event is then compared to the parameters desired for attaining the clinical result or ameliorated maturation (e.g. amplitude of impact load, rate of impact). The success or failure of the exercise attempt to meet these criteria is made known to the individual by the device. This process is repeated until a prescribed number of successful exercise impacts has been accomplished. Attainment of this endpoint is also made known to the individual by feedback unit 24. This set of successful exercises is repeated at an interval (e.g. daily) determined by physicians to be efficacious for the patient's particular clinical condition.

It should be noted that these criteria are, in practice, not necessarily fixed for all time. Rather, they represent a progression of levels which are revised by the physician caring for the patient in accordance with measures of clinical response (a "spring training" regimen).

In practice, the configuration of the impacted surface must be appropriate for each clinical situation. For example, a patient with a fractured tibia will usually have his or her lower leg placed in a plaster or plastic cast; this often involves some degree of equinus positioning. In order to facilitate axial compressions of the tibia, the impacted surface must allow for the heel region to strike the surface. This may be accomplished by elevating the impacted surface above the remainder of the device (so that the forefoot does not impact the device), or placing it so that the forefoot extends beyond the edges of the device (and thus does not sustain an impact).

The present invention is directed to a mechanical means of producing endogenous electrical signals. An advantage of the present invention is that it is compatible with and complementary to exogenously-produced electrical signals, such as from electrodes or time-varying electromagnetic fields.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of the general inventive concept as defined by the appended claims and their equivalents.

What is claimed is:

1. A method of providing active exercise treatment for increasing the amount, strength and proper anatomical distribution of skeletal tissue in a patient suffering from a bone disorder, the method comprising the steps of:

determining, from selected characteristics of the patient's skeletal tissue, a desired value for impact load and impact rate in order to provide treatment for the bone disorder, the desired impact load and impact rate values being chosen to generate electrical signals in the patient's skeletal tissue such that the predominant energy distribution will be between 0.1 Hz and 100 KHz, with notable energy distribution in the range of 6 to 16 Hz;

repeatedly striking a plate by the patient in a manner to produce an impact load along the axis of a bone experiencing the bone disorder;

automatically measuring the impact load value at a sensor mounted to the plate generated from the patient's striking of the plate;

automatically measuring the impact rate value of said striking of the plate;

automatically comparing the measured impact load value with the desired impact load value and automatically comparing the desired impact rate value with the measured impact rate value to determine a success indicator value indicating the difference between the desired impact load and impact rate values and the measured impact load and impact rate values;

providing the success indicator value to the patient automatically as feedback for the active exercise treatment; and recording the determined success indicator value of the active exercised treatment.

2. The method of claim 1 wherein the step of determining the value of impact load and impact rate includes the substep of determining the amount of bone in the patient's skeletal tissue.

3. The method of claim 1 wherein the step of determining the value for impact load and impact rate includes the substep of determining the strength of bone in the patient's skeletal tissue.

4. The method of claim 1 wherein the step of determining the value for impact load and impact rate includes the substep of determining the anatomical distribution of bone in the patient's skeletal tissue.

5. The method of claim 1 wherein the step of determining the value for impact load and impact rate includes the substep of determining the nature of the bone disorder.

6. A device for providing active exercise treatment for increasing the amount, strength and proper anatomical distribution of skeletal tissue in a patient suffering from a bone disorder by causing a desired impact load value to be imparted to the patient at a desired impact rate value such that the impact at the desired load value and rate value causes said patient's skeletal tissue to generate an electrical signal having the majority of its energy between 0.1 Hz and 100 KHz, with notable energy distribution in the range of 6 to 16 Hz, the device comprising:

impact generating means for producing an impact load to the patient along the axis of a bone experiencing the bone disorder when struck by the patient;

sensing means, operatively connected to said impact generating means, for forming an impact signal indicating the impact load generated when the impact generating means is struck by the patient;

measuring means including impact load measuring means, coupled to said sensing means, for receiving the impact signal from the sensing means and measuring the impact load generated from said striking of said impact generating means; and impact rate measuring means, coupled to said sensing means, for receiving the impact signal from the sensing means and measuring the rate of striking said impact generating means by said patient;

processing means, coupled to said impact load measuring means and to said impact rate measuring means, for comparing the measured impact load with said desired impact load values and for comparing the measured impact rate with the desired impact rate values to determined a success indicator value indicating the difference between said desired impact load and impact rate values and the measured impact load and impact rate values;

feedback means, coupled to said processing means, for converting said success indicator value to feedback perceivable by said patient in the active exercise treatment; and recording means, coupled to said processing means, for recording said determined success indicator value of the active exercise treatment.

7. The device of claim 6 wherein said sensing means includes a resistive strain-gauge sensor.

8. The device of claim 6 wherein said sensing means includes a piezoelectric device.

9. The device of claim 6 wherein said sensing means includes an acoustic transducer.

10. The device of claim 6 wherein said sensing means includes an accelerometer.

11. The device of claim 6 wherein said sensing means includes an interferometer.

12. The device of claim 6 wherein said measuring means includes an analog-to-digital converter for converting the output rate of said sensing means to a digital signal.

13. The device of claim 6 wherein said processing means includes a microprocessor.

14. The device of claim 6 wherein the processing means includes a discrete digital microelectronic logic device.

15. The device of claim 6 wherein said feedback means includes a light-emitting device.

16. The device of claim 6 wherein said feedback means includes a tone-producing circuit.

17. The device of claim 16 wherein said tone-producing circuit includes a buzzer.

18. The device of claim 6 wherein said feedback means includes a visually-detectable meter.

19. The device of claim 6 wherein said feedback means includes a device for emitting synthesized speech sounds.

20. The device of claim 6 wherein said recording means includes a printer for recording the success indicator.

21. The device of claim 7 wherein the recording means includes a microelectronic memory device.

* * * * *